US006398499B1

(12) United States Patent
Simonetti et al.

(10) Patent No.: US 6,398,499 B1
(45) Date of Patent: Jun. 4, 2002

(54) FAN BLADE COMPLIANT LAYER AND SEAL

(75) Inventors: Joseph Simonetti, Duluth, GA (US); Bruce Wilson, Chandler, AZ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 09/813,626

(22) Filed: Mar. 19, 2001

Related U.S. Application Data

(63) Continuation-in-part of application No. 09/690,216, filed on Oct. 17, 2000.

(51) Int. Cl.[7] ..... F01D 5/22
(52) U.S. Cl. ..... 416/193 A; 416/248
(58) Field of Search ..... 416/193 A, 248, 416/219 R

(56) References Cited

U.S. PATENT DOCUMENTS

| | | | | |
|---|---|---|---|---|
| 3,266,771 A | | 8/1966 | Morley | |
| 4,019,832 A | | 4/1977 | Salemme et al. | |
| 4,183,720 A | | 1/1980 | Brantley | |
| 4,326,835 A | | 4/1982 | Wertz | |
| 4,422,827 A | | 12/1983 | Buxe et al. | |
| 4,457,668 A | | 7/1984 | Hallinger | |
| 4,875,830 A | | 10/1989 | Trousdell et al. | |
| 5,139,389 A | * | 8/1992 | Eng et al. | 416/248 |
| 5,160,243 A | | 11/1992 | Herzner et al. | |
| 5,240,375 A | | 8/1993 | Wayte | |
| 5,281,097 A | | 1/1994 | Wilson et al. | |
| 5,513,955 A | | 5/1996 | Barcza | |
| 5,573,375 A | | 11/1996 | Barcza | |
| 5,599,170 A | * | 2/1997 | Marchi et al. | 416/190 |
| 5,611,669 A | | 3/1997 | Royle | |
| 5,820,338 A | * | 10/1998 | Kasprow et al. | 415/134 |
| 5,827,047 A | | 10/1998 | Gonsor et al. | |
| 5,890,874 A | | 4/1999 | Lambert et al. | |
| 5,924,699 A | | 7/1999 | Airey et al. | |
| 6,146,099 A | | 11/2000 | Zipps et al. | |
| 6,202,273 B1 | * | 3/2001 | Watts | 29/243.56 |

* cited by examiner

*Primary Examiner*—Edward K. Look
*Assistant Examiner*—Ninh Nguyen
(74) *Attorney, Agent, or Firm*—Robert Desmond, Esq.

(57) ABSTRACT

A compliant shim for use between the root of a gas turbine fan blade and a dovetail groove in a gas turbine rotor disk to reduce fretting therebetween. The compliant shim has first and second slots for engaging tabs extending from the fan blade root. The slots and tabs cooperate to hold the shim during engine operation. An oxidation layer covers the compliant shim. The shim is augmented with an upstanding wall and a seal element to seal the gap that exists between platform edges of adjacent fan blades. This simple combination solves two complex problems, fatigue of fan assembly parts and loss of operating efficiency caused by fluid flow leakage.

11 Claims, 6 Drawing Sheets

FAN BLADE COMPLIANT LAYER AND SEAL

CROSS-REFERENCE TO RELATED APPLICATIONS

This is a continuation-in-part of U.S. patent application filed Oct. 17, 2000, Ser. No. 09/690,216.

BACKGROUND OF THE INVENTION

This invention relates generally to gas turbine engines and, in particular, to a compliant shim used between the dovetail root base of a fan or compressor blade and the corresponding dovetail groove in a fan or compressor disk, together with a seal layer to seal a gap that exists between adjacent compressor blade platform elements.

As discussed in the Herzner et al., U.S. Pat. No. 5,160,243, when two pieces of material rub or slide against each other in a repetitive manner, the resulting frictional forces may damage the materials through the generation of heat or through a variety of fatigue processes generally termed fretting. Some materials, such as titanium contacting titanium, are particularly susceptible to such damage. When two pieces of titanium are rubbed against each other with an applied normal force, the pieces can exhibit a type of surface damage called galling after as little as a hundred cycles. The galling increases with the number of cycles and can eventually lead to failure of either or both pieces by fatigue.

The use of titanium parts that can potentially rub against each other occurs in several aerospace applications. Titanium alloys are used in aircraft and aircraft engines because of their good strength, low density, and favorable environmental properties at low and moderate temperatures. If a particular design requires titanium pieces to rub against each other, the type of fatigue damage just outlined may occur.

In one type of aircraft engine design, a titanium compressor disk also referred to as a rotor or fan disk has an array of dovetail slots in its outer periphery. The dovetail base of a titanium compressor blade or fan blade fits into each dovetail slot of the disk. When the disk is at rest, the dovetail of the blade is retained within the slot. When the engine is operating, centrifugal force induces the blade to move radially outward. The sides of the blade dovetail slide against the sloping sides of the dovetail slot of the disk, producing relative motion between the blade and the rotor disk.

This sliding movement occurs between the disk and blade titanium pieces during transient operating conditions such as engine startup, power-up or takeoff, power-down and shutdown. With repeated cycles of operation, the sliding movement can affect surface topography and lead to a reduction in fatigue capability of the mating titanium pieces. During such operating conditions, normal and sliding forces exerted on the rotor in the vicinity of the dovetail slot can lead to galling, followed by the initiation and propagation of fatigue cracks in the disk. It is difficult to predict crack initiation or extent of damage as the number of engine cycles increases. Engine operators, such as the airlines, must therefore inspect the insides of the rotor dovetail slots frequently, which is a highly laborious process.

Various techniques have been tried to avoid or reduce the damage produced by the frictional movement between the titanium blade dovetail and the dovetail slot of the titanium rotor disk. One technique is to coat the contacting regions of the titanium pieces with a metallic alloy to protect the titanium parts from galling. The sliding contact between the two coated contacting regions is lubricated with a solid dry film lubricant containing primarily molybdenum disulfide to further reduce friction.

While this approach can be effective in reducing the incidence of fretting or fatigue damage in rotor/blade pieces, the service life of the coating has been shown to vary considerably. Furthermore, the process for applying the metallic alloy to the disk and the blade pieces has been shown to be capable of reducing the fatigue capability of the coated pieces. There exists a continuing need for an improved approach to reducing such damage and assure component integrity. Such an approach would desirably avoid a major redesign of the rotor and blades, which have been optimized over a period of years, while increasing the life of the titanium components and the time between required inspections. The present invention fulfills this need, and further provides related advantages.

U.S. Pat. Nos. 5,160,243 and 5,240,375 disclose a variety of single layer and multi-layer shims designed for mounting between the root of a titanium blade and its corresponding groove in a titanium rotor. The simplest of these shims is a U-shaped shim designed to be slid over the root of the fan blade (see FIG. 3 of the '243 patent). A disadvantage to this type of shim is that it has a tendency to come lose during engine operation. Also, it does not entirely eliminate the fretting between the groove and the fan blade root.

Various methods for sealing the gap formed between the adjacent edges of the platforms of installed fan blades are known in the art. Examples include U.S. Pat. Nos. 5,827,047; 6,146,099; and 4,183,720. The '047 patent is typical of seals which are positioned under the platform of fan blades by means of special structural elements formed in portions of the fan blade. Such applications require significant changes to the existing structure of fan assemblies.

The '099 and '720 patents represent examples of the bonding of strips of material to the underside of the platforms of fan blades. While this appears to be a simple solution to the gap sealing problem, the method introduces problems with types, strength and durability of the bonding substance.

As can be seen, there is a need for an improved compliant shim to inhibit fretting between titanium components and a mechanism for holding such a shim in place during engine operation, as well as a need for a shim to seal the gap that exists between adjacent compressor blade platform elements.

SUMMARY OF THE INVENTION

The present invention uses an easily installed compliant shim element to position a seal element by means of an upstanding wall element. The shim element is easy to install and retains the wall and seal in proper position to seal the gap between adjacent fan blades. The centrifugal load of the rotating fan assembly forces the seal element firmly against the fan blade platforms. This structure supplies a simple solution for two complex problems of performance of turbine fan assemblies. The part is simple to manufacture in that it may be a sheet metal stamping.

An improved compliant shim for eliminating fretting between titanium components and a mechanism for holding such a shim in place during engine operation in accordance with the present invention comprises a compliant shim for use between the root base of a gas turbine fan blade and a dovetail groove in a gas turbine rotor disk to reduce fretting therebetween. The compliant shim has first and second slots for engaging tabs extending from the fan blade root. The slots and tabs cooperate to hold the shim during engine operation. An oxidation layer covers the compliant shim and reduces fretting between the blade and the compliant layer. The invention further comprises an extended seal layer element to seal the gap that exists between adjacent fan blade platform elements.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
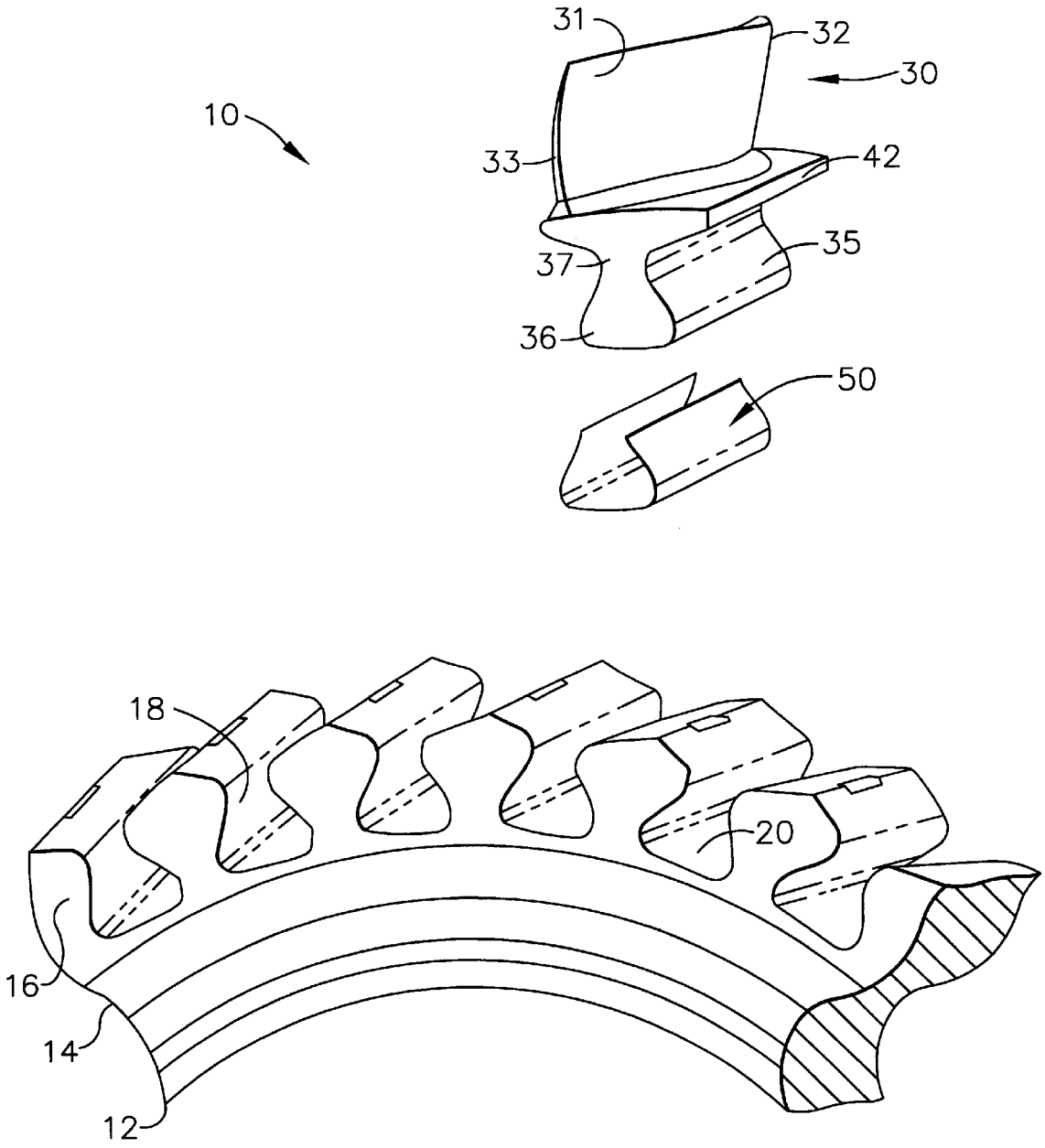
FIG. 1 illustrates an exploded view of a rotor assembly contemplated by the present invention.

Referring to FIG. 1, a fan assembly is generally denoted by the reference numeral 10. The assembly 10 includes a disk 12 having an annular web portion 14 and an outer periphery 16 having a plurality of dovetailed configured grooves 18 with radially outward facing base surfaces 20. The grooves 18 extend through the periphery 16 at an angle between the disk's 12 axial and tangential axes referred to as disk slot angle.

Fan blades 30 are carried upon the outer periphery 16. Each blade 30 includes a radially upstanding airfoil portion 31 that extends from a leading edge 32 to a trailing edge 33. Each blade 30 also has a root portion 35 with a root neck 37 and a dovetail shaped base 36 to be received by one of the grooves 18. At its leading and trailing edges, the root portion 35 has tabs 38, 39 that extend radially inward toward the base surface 20 to define a gap between the base surface 20 and a bottom surface 41 of the root portion 35. A tab 40 adjacent the tab 39 extends further inward and abuts an axially facing surface of the outer periphery 16. The tab 40 is commonly referred to as a beaver tooth. In the preferred embodiment, the disk 12 and fan blade 30 are made from titanium or titanium alloys.

Figure 2:
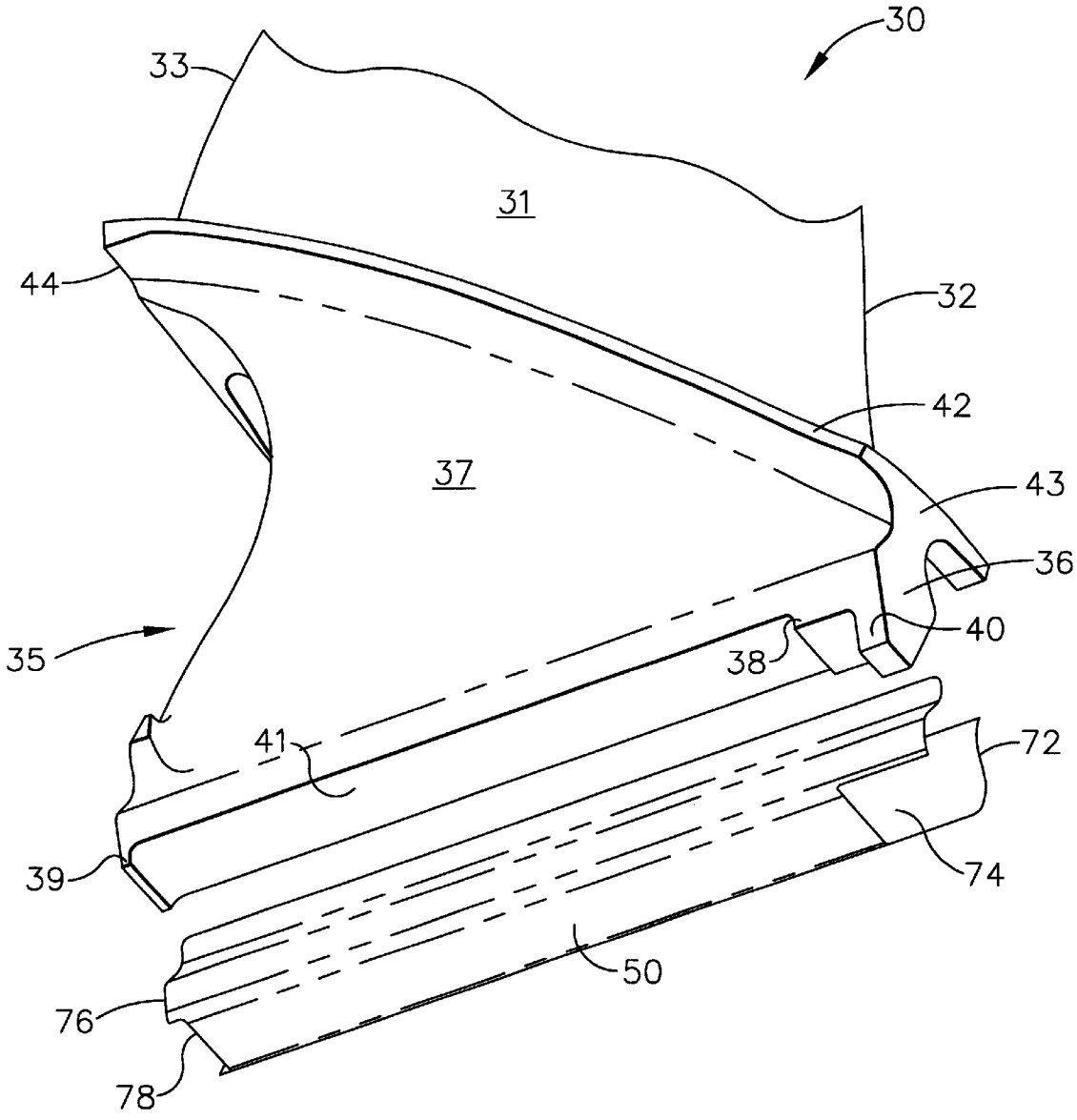
FIG. 2 illustrates a perspective view of a blade assembly having the compliant sleeve contemplated by the present invention.
Figure 3:
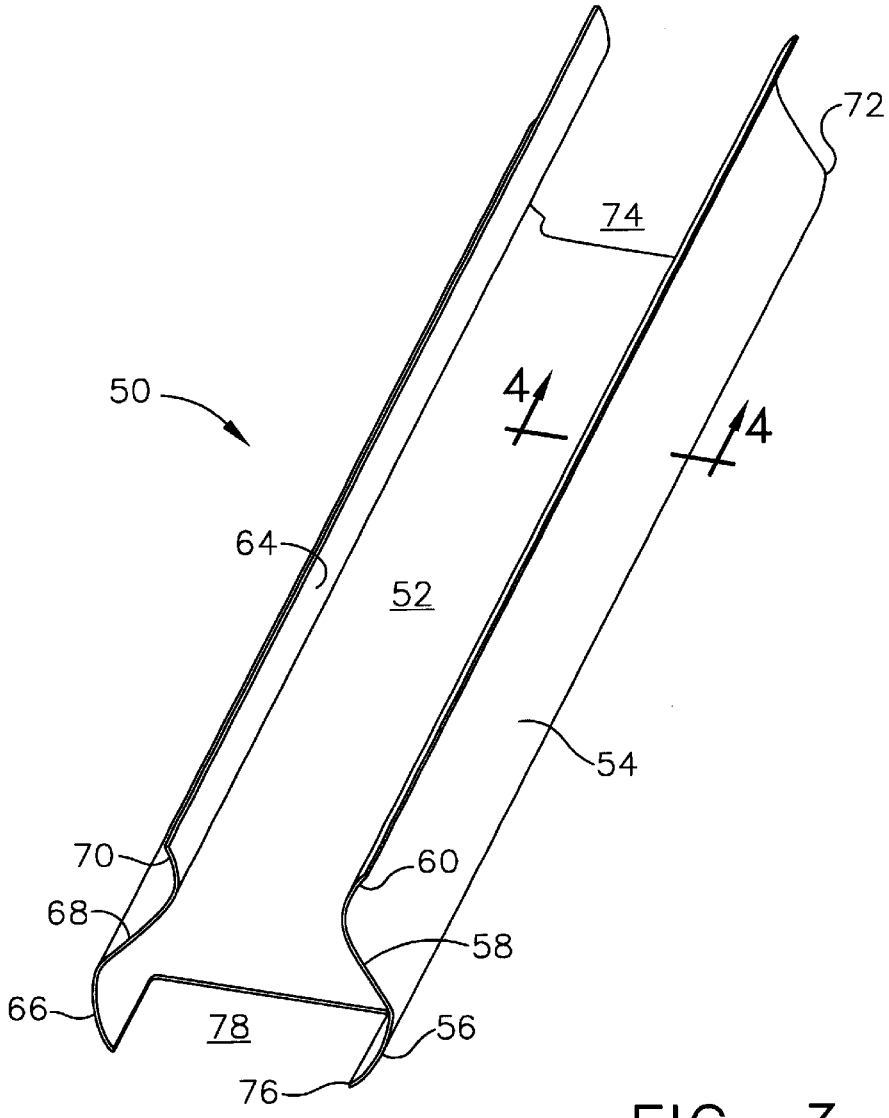
FIG. 3 illustrates a perspective view of the compliant sleeve contemplated by the present invention.
Figure 4:
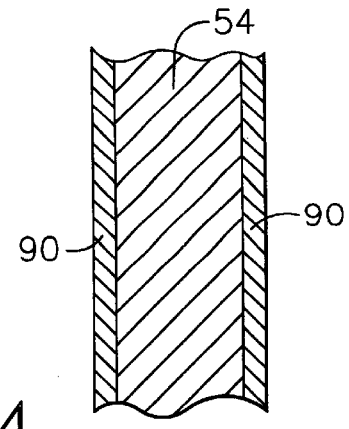
FIG. 4 illustrates a cross-sectional view taken along line 4—4 of FIG. 3.

Referring to FIGS. 2 and 3, the shim 50 is a thin, layered sheet formed for mounting in the gap between the base surface 20 and the bottom surface 41. The shim 50 has a flat base 52 and two spaced apart walls 54, 64 that extend outward from the base 52. Each of the walls 54, 64 is curvilinear and has a first portion 56, 66 that curves away from each other, a second portion 58, 68 that curves toward each other and a third portion 60, 70 that curves away from each other. The shim 50 extends from a first end 72 to a second end 76. The end 72 has a slot 74 for receiving tab 38 and the end 76 has a slot 78 for receiving tab 39. The blade 30 is mounted to the disk 12 by sliding a shim onto the root base 36 and then inserting the shimmed blade into a dovetail slot in a manner familiar to those skilled in the art. Referring to FIG. 4, the shim 50 has an oxidation layer 90 over both its inner and outer surfaces. The layer 90 has a thickness in the range of 0.0002 to 0.0003 inch on each side and is formed by heat treating the shim in an air atmosphere at 2075° F. for 14 to 16 minutes. The shim is preferably made of a cobalt alloy such as L605.

Thus, a shim 50 is provided that prevents fretting between the fan blade root and its corresponding disk slot. Further, the shim 50 is slotted to engage tabs extending downward from the blade root, which then hold the shim in place during the operation of the engine.

Figure 5:
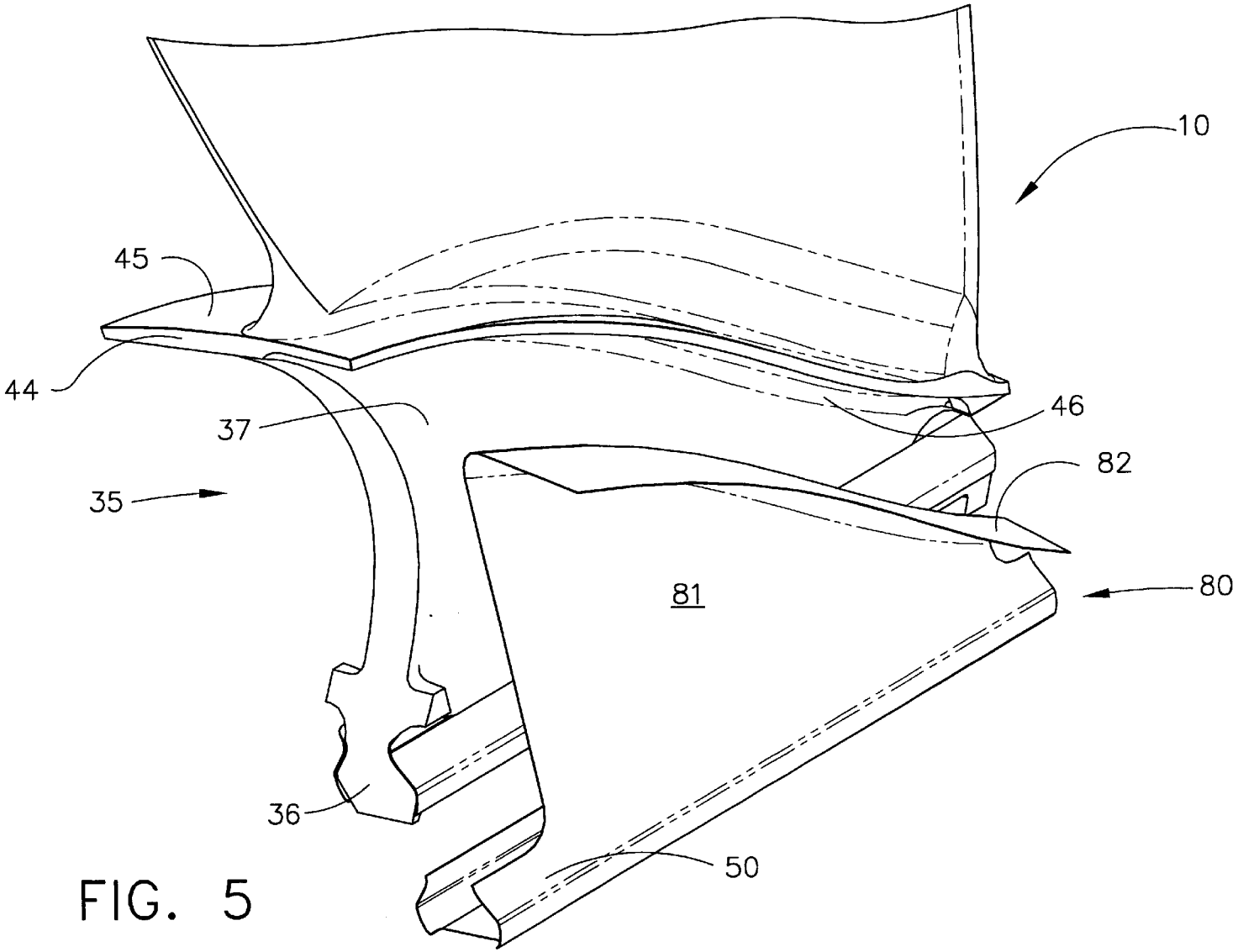
FIG. 5 illustrates a perspective view of the compliant sleeve with a seal positioned for assembly with a fan blade contemplated by the present invention.
Figure 6:
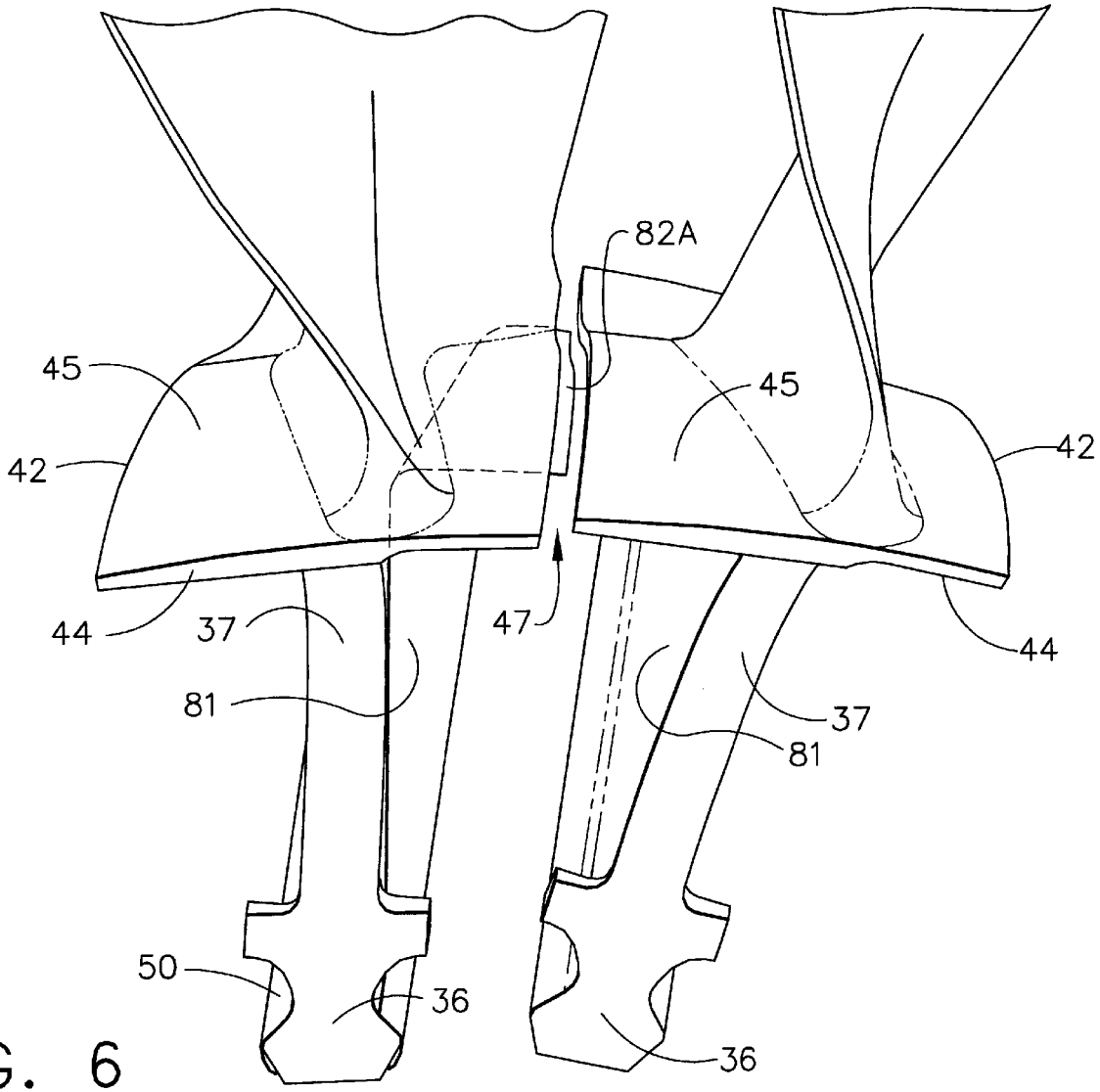
FIG. 6 illustrates two adjacent fan blades with the compliant sleeve and seal installed as contemplated by the present invention.
Figure 7:
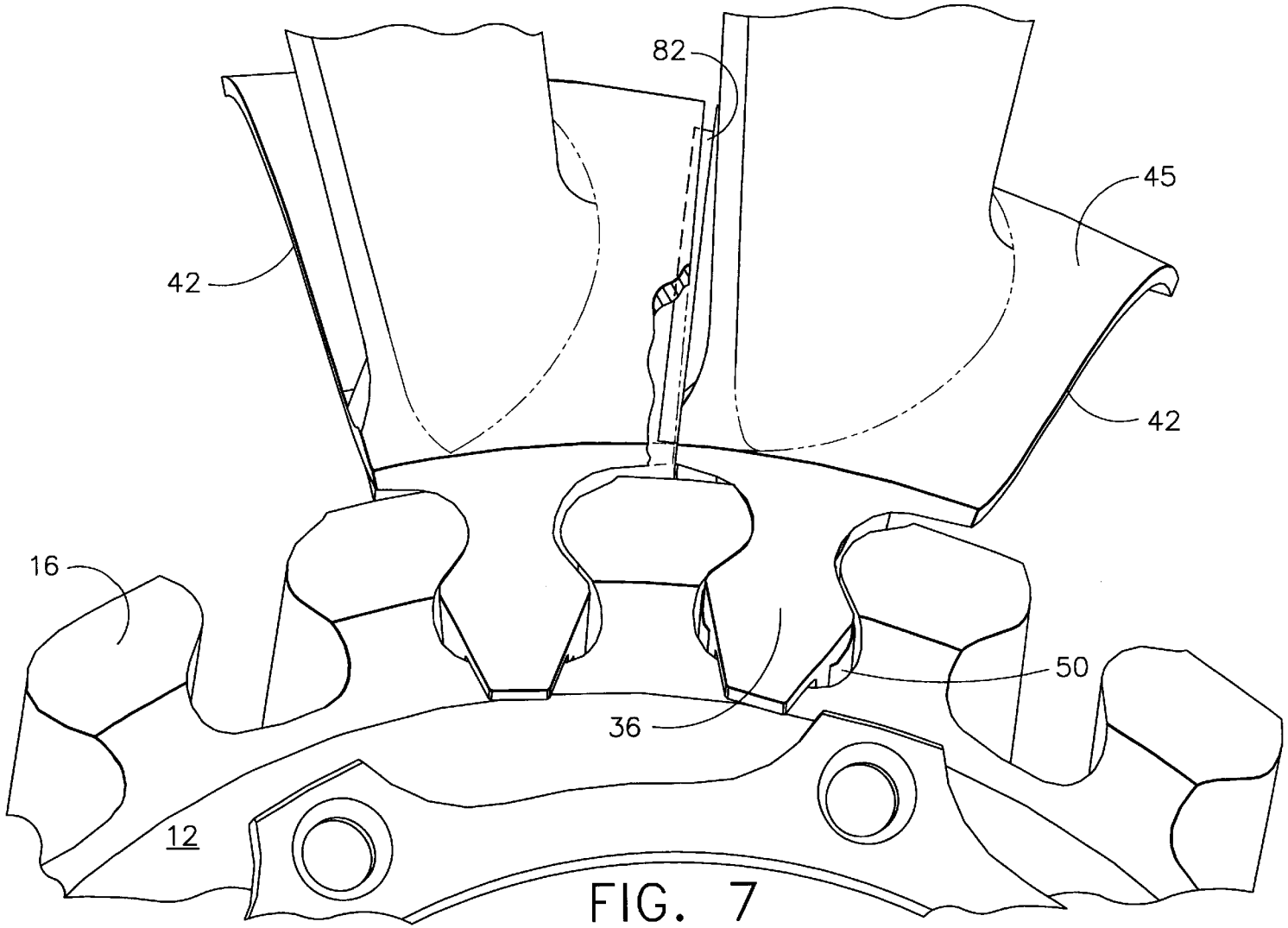
FIG. 7 illustrates a perspective view of the present invention installed on a fan assembly and disk.

Referring to FIGS. 5 through 7, the fan assembly 10 has a platform 42 disposed radially between the root portion 35 and an airfoil portion 31. The platform 42 extends circumferentially from the airfoil portion 31. The platform 42 includes a leading edge portion 43 and trailing edge portion 44. The platform 42 also has an outer surface 45 defining a fluid flow path and an inner surface 46.

A compliant layer and seal 80 includes the shim 50 with an upstanding wall portion 81 and seal element 82 substantially perpendicular thereto that provides a generally L-shaped configuration. Preferably, the upstanding wall portion 81 is configured and dimensioned to mate to the configuration and dimension of the surface of the root neck 37. Thereby, wall portion 81 may extend across the entire surface of the root neck 37, although it is not necessary. The seal element 82 is preferably configured and dimensioned to mate to the configuration and dimension of the inner surface 46 of the platform 42 such that the seal element 82 may extend across the entire inner surface 46. However, the seal element 82 may only extend across a portion.

The shim portion 50 is installed on a first fan assembly 10 base 36 as previously disclosed. This positions the wall portion 81 against the surface of the root neck 37. The seal element 82 is thereby positioned against inner surface 46 with an edge portion 82*a* of the seal element 82 extending beyond the edge or periphery of the first platform 42 for positioning against the inner surface 46 of a second platform 42 of an adjacent or second blade of the fan assembly 10. Preferably, the edge portion 82*a* extends along the entire edge of the first platform, as well as the second platform, although it is not a necessity. The present invention uses the easily installed compliant shim element to also position a seal element by means of an upstanding wall element. The shim portion is easy to install and retains the wall and seal in proper position to seal the gap between adjacent fan blades. The centrifugal load of the rotating fan assembly forces the seal element firmly against the fan blade platforms. This structure supplies a simple solution for two complex problems of performance of turbine fan assemblies. The part is simple to manufacture in that it may be a sheet metal stamping. The positioning of the seal element 82 thereby acts to seal the gap 47 between the edges of two adjacent platforms 42.

The compliant layer and seal 80 serves to minimize fretting of pressure flats of a fan assembly 10 and to seal gaps between adjacent fan blade platforms 42 to inhibit fluid leakage from the high pressure side of the fan blade 30 to the low pressure side. The instant invention functions to extend the life of parts of the fan assembly 10 and to improve the efficiency of the turbine engine by minimizing the passage of fluid through portions of the fan assembly 10 where useful work cannot be accomplished. The sealing feature of the device may be enhanced by applying an additional material, such as silicon rubber, to the upper surface of the seal element.

It should be understood, of course, that the foregoing relates to preferred embodiments of the invention and that modifications may be made without departing from the spirit and scope of the invention as set forth in the following claims.

We claim:

1. A rotor assembly for a gas turbine engine, comprising:

a disk having along its periphery at least one dovetail groove;

a first blade having an airfoil portion and a root portion, said root portion contoured to be received within said dovetail groove and having a bottom surface that extends axially from a leading edge to a trailing edge, said bottom surface having first and second tab members extending inward therefrom to define a gap between said bottom surface and a base of said groove; and a compliant shim disposed in said gap and having a first slot for engaging said first tab and a second slot for engaging said second tab;

said compliant shim further comprising:

an upstanding wall portion disposed against said root portion; and a seal element disposed against a first platform of said assembly, as well as disposed radially between said airfoil portion and said root portion, wherein said seal element extends beyond a periphery of said first platform.

2. The assembly of claim 1, wherein said upstanding wall portion and seal element are in a generally L-shaped configuration.

3. The assembly of claim 2, wherein said upstanding wall portion is disposed against a neck of said root portion.

4. The assembly of claim 3, wherein said seal element further comprises an edge portion disposed between said first platform and a second platform of a second blade of said assembly.

5. The assembly of claim 4, wherein said edge portion is in contact with said second platform.

6. The assembly of claim 5, wherein said seal element is disposed against an inner surface of said first platform.

7. The assembly of claim 1, wherein said shim further comprises a flat base and two spaced apart walls extending therefrom.

8. The assembly of claim 7, wherein each of said walls is curvilinear.

9. The assembly of claim 8, wherein said walls have first portions that curve away from each other, second portions that curve towards each other, and third portions that curve away from each other.

10. The assembly of claim 1, further comprising an oxidation layer over at least a portion of said shim.

11. The assembly of claim 10, wherein the thickness of said oxidation is in the range of 0.0002 to 0.0003 inch.

* * * * *